US011300390B1

(12) United States Patent
Sesler et al.

(10) Patent No.: US 11,300,390 B1
(45) Date of Patent: Apr. 12, 2022

(54) CONTROL SURFACE DEPLOYMENT APPARATUS AND METHOD OF USE

(71) Applicant: Dynamic Structures and Materials, LLC, Franklin, TN (US)

(72) Inventors: Joshua J. Sesler, Franklin, TN (US); Bert K. McMahan, Brentwood, TN (US); Mark C. McMahan, Nashville, TN (US)

(73) Assignee: Dynamic Structures and Materials, LLC, Franklin, TN (US)

( * ) Notice: Subject to any disclaimer, the term of this patent is extended or adjusted under 35 U.S.C. 154(b) by 329 days.

(21) Appl. No.: 16/288,978

(22) Filed: Feb. 28, 2019

Related U.S. Application Data

(60) Provisional application No. 62/638,404, filed on Mar. 5, 2018.

(51) Int. Cl.
*F42B 10/14* (2006.01)

(52) U.S. Cl.
CPC ..... *F42B 10/14* (2013.01)

(58) Field of Classification Search
CPC ..... F42B 10/14; F42B 10/06; F42B 10/64
See application file for complete search history.

(56) References Cited

U.S. PATENT DOCUMENTS 3,063,375 A 11/1962 Hawley et al.
3,102,437 A 9/1963 Geyer
3,125,956 A 3/1964 Kongelbeck
3,127,838 A 4/1964 Moratti et al.
3,154,015 A 10/1964 Muller
3,333,790 A 8/1967 Durand, Jr.
3,711,040 A 1/1973 Carver
4,029,270 A 6/1977 Niemeier
4,175,720 A 11/1979 Craig
4,296,895 A 10/1981 Pazmany
4,323,208 A 4/1982 Ball
4,334,657 A 6/1982 Mattson
4,336,914 A 6/1982 Thomson
4,398,682 A 8/1983 Bithrey
4,438,893 A 3/1984 Sands et al.
4,560,121 A 12/1985 Terp
4,575,025 A 3/1986 Sadvary et al.
4,592,525 A 6/1986 Madderra et al.
4,600,167 A 7/1986 Kastenhuber et al.
4,659,036 A 4/1987 Pinson
4,659,037 A 4/1987 Unterstein
4,660,786 A 4/1987 Brieseck et al.
4,664,339 A * 5/1987 Crossfield ..... F42B 10/14 244/3.28
4,667,899 A * 5/1987 Wedertz ..... F42B 10/14 244/218

(Continued)

*Primary Examiner* — Benjamin P Lee
(74) *Attorney, Agent, or Firm* — Master Key IP; Jeromye V. Sartain

(57) ABSTRACT

A control surface deployment apparatus having a base part, a drive actuator operably installed adjacent to the base part and having a drive actuator shaft extending beyond the base part, a knuckle part installed on the drive actuator shaft so as to selectively rotate therewith, a hinge part pivotally installed on the knuckle part as through a hinge pin, a fin rigidly installed on the hinge part so as to extend away from the knuckle part, and a spring biasing element configured to pivotally bias the hinge part relative to the knuckle part.

21 Claims, 6 Drawing Sheets

(56) References Cited

U.S. PATENT DOCUMENTS

| | | | | | |
|---|---|---|---|---|---|
| 4,678,142 | A | | 7/1987 | Hirschfeld | |
| 4,702,436 | A | | 10/1987 | Arnell | |
| 4,709,877 | A | | 12/1987 | Goulding | |
| 4,844,386 | A | | 7/1989 | Brieseck | |
| 4,869,442 | A | | 9/1989 | Miller | |
| 5,048,772 | A | | 9/1991 | Wisshaupt | |
| 5,082,203 | A | | 1/1992 | Baubry | |
| 5,108,051 | A | * | 4/1992 | Montet | F42B 10/14 244/3.28 |
| 5,211,357 | A | | 5/1993 | Leidenberger | |
| 5,240,203 | A | | 8/1993 | Myers | |
| 5,249,761 | A | | 10/1993 | Schroppel | |
| 5,326,049 | A | * | 7/1994 | Rom | F42B 10/14 102/388 |
| 5,464,173 | A | | 11/1995 | Sharrow et al. | |
| 5,584,448 | A | | 12/1996 | Epstein et al. | |
| 5,762,294 | A | | 6/1998 | Jimmerson | |
| 5,950,963 | A | | 9/1999 | Speicher et al. | |
| 5,975,461 | A | | 11/1999 | Ullrich | |
| 6,073,880 | A | | 6/2000 | Voigt et al. | |
| 6,092,264 | A | | 7/2000 | Banks | |
| 6,186,443 | B1 | | 2/2001 | Shaffer | |
| 6,224,013 | B1 | * | 5/2001 | Chisolm | F42B 10/14 244/3.27 |
| 6,247,666 | B1 | | 6/2001 | Baker et al. | |
| 6,352,218 | B1 | | 3/2002 | Holmqvist et al. | |
| 6,364,248 | B1 | | 4/2002 | Spate et al. | |
| 6,446,906 | B1 | | 9/2002 | Voigt et al. | |
| 6,726,147 | B1 | | 4/2004 | Perini et al. | |
| 6,761,331 | B2 | * | 7/2004 | Eisentraut | F42B 10/14 244/3.28 |
| 6,800,780 | B2 | | 10/2004 | Ooms et al. | |
| 6,905,093 | B2 | | 6/2005 | Dryer et al. | |
| 6,981,672 | B2 | | 1/2006 | Clancy et al. | |
| 7,059,561 | B2 | * | 6/2006 | Trouillot | F42B 10/14 244/3.28 |
| 7,642,492 | B2 | * | 1/2010 | Parine | F42B 10/14 244/3.27 |
| 7,732,741 | B1 | * | 6/2010 | Whitham | F42B 10/14 244/3.27 |

* cited by examiner

CONTROL SURFACE DEPLOYMENT APPARATUS AND METHOD OF USE

GOVERNMENT LICENSE RIGHTS

Pursuant to 35 U.S.C. § 202(c)(6) or otherwise, Applicant (s) hereby disclose that this invention was made with government support under contract number N00014-11-C-0418 awarded by the Office of Naval Research ("ONR"). The government has certain rights in the invention.

RELATED APPLICATIONS

This non-provisional patent application claims priority pursuant to 35 U.S.C. § 119(e) to and is entitled to the filing date of U.S. Provisional Patent Application Ser. No. 62/638,404 filed Mar. 5, 2018, and entitled "Control Surface Deployment Apparatus and Method of Use." The contents of the aforementioned application are incorporated herein by reference.

BACKGROUND

The subject of this patent application relates generally to flight control surfaces, and more particularly to flight control surfaces configured for efficient storage and deployment.

The following description includes information that may be useful in understanding the present invention. It is not an admission that any of the information provided herein is prior art or relevant to the presently claimed invention, or that any publication specifically or implicitly referenced is prior art.

Applicant(s) hereby incorporate herein by reference any and all patents and published patent applications cited or referred to in this application, to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

By way of background, many projectiles, such as missiles or mortar-launched projectiles, are guided by using steerable control surfaces like fins or canards. Protruding fins or canards (hereinafter "fins") can often provide storage and firing challenges, as they can take up valuable packaging space within the missile launch tube, mortar breech, wing, or similar area. Previously, engineers have overcome this obstacle by designing deployable fins that are stowed within the body of the main projectile before being launched and are then deployed into the airstream at some point after launch or drop. Many mechanisms currently used for such deployment rely on a secondary actuator internal to the projectile to deploy the one or more fins. Additionally, many projectiles (especially mortar- or gun-launched projectiles) must survive extreme accelerations of up to 30,000 g's or more. In these instances, stowed fins will generate very high forces on the deployment mechanism itself.

Representative prior art references, as a non-limiting, exemplary sampling, include:

In U.S. Pat. No. 7,475,846 to Schroeder, there is disclosed a system in which a single motor is able to both deploy and control canards. In that system, a single motor is used to release a compression spring, which extends and deploys the canards. However, the entire mechanism and the canards when stored are housed within the projectile.

In U.S. Pat. No. 4,664,339 to Crossfield, there is disclosed a fin that folds flat to the projectile body and deploys into the airstream by way of a complex hinge that rotates about a single complex axis. This is an innovative solution, but the components to implement it are relatively complex and costly to machine.

In U.S. Pat. No. 4,869,442 to Miller, there is disclosed an airstream driven deployment mechanism after being started by spring assist and so is relatively ineffective in applications where the fins stow pointed toward the rear of the projectile and need to deploy in flight against the airstream.

And finally, in U.S. Pat. No. 4,323,208 to Ball, there is disclosed a unique fin deployment mechanism where the fins deploy from a position flat against the projectile body by means of worm gears and direct actuator rotation. This invention is motor powered, but its rotation path to the fully deployed position translates through positions that are likely to cause significant aerodynamic disturbances and drag due to the exposed surface area temporarily in the airstream.

Therefore, what has been needed and heretofore unavailable is an improved means to store a fin during launch or initial deployment and the ability to deploy the fin using only the primary motor or actuator that will later steer the fin to provide projectile guidance, which is advantageous over current systems in that the deployment and driving of each fin is done with a single actuator versus a separate, dedicated actuator for deployment, the fins stow in a volume advantageous position flat against the projectile body, no aerodynamic aid is required for deployment, and aerodynamic drag is minimized during fin deployment. Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing an improved control surface deployment apparatus and method of use. Generally, one or more flight control surfaces may be deployed by use of an actuator that will ultimately drive the flight control surface(s) to provide projectile guidance. The flight control surface(s) are stowed in a volume efficient manner and deployed in a way that minimizes aerodynamic drag and does not require aerodynamic assistance. There is thus beneficially provided such a control surface deployment apparatus wherein in a first stage of deployment the control surface or fin is rotated only in a plane substantially parallel to the primary axis of projectile travel and in a second stage of deployment the fin is pivoted only about an axis that is substantially parallel to the primary axis of projectile travel, whereby at all times throughout both the first and second deployment stages the fin remains oriented with its leading edge into the airstream so as to be substantially parallel to the airstream.

In at least one embodiment, during storage and initial launch, the fin is stowed with its lengthwise axis, or the axis of the fin itself about which it rotates when in its deployed state, substantially parallel to the primary axis of projectile travel, or the central lengthwise axis of the projectile, and with the chord of the fin substantially parallel to a plane that is substantially perpendicular to the primary axis of rotation of the fin in its deployed state, or the axis of the actuator drive shaft and thus the lengthwise axis of the fin itself when deployed. When the fin is to be deployed, the fin drive actuator is engaged in the first deployment stage to rotate the fin from its stowed position substantially parallel to the axis of travel to its deployment position substantially perpendicular to the axis of travel, or the central lengthwise axis of the projectile, whereby the fin will see a minimum amount of aerodynamic load as it enters the airstream. After the fin has traveled approximately ninety degrees (90°) so as to complete the first stage of deployment, the fin will be oriented with the leading edge substantially perpendicular to the direction of travel, or directed toward or into the airstream. In commencing the second stage of deployment of the fin, a deployment spring will then cause rotation about a secondary axis at the base of the fin which is perpendicular to the primary rotation axis of the fin and is at that point substantially parallel with the primary travel direction or central lengthwise axis of the projectile. Meanwhile, a retaining protrusion has slid across a specifically designed surface at the base of the deployment mechanism, which features together operate such that the fin will not deploy while pivoting from the stowed position to the ninety degree (90°) position, or throughout the first deployment stage, but will allow the fin to deploy once it has reached the designated deployment position at approximately ninety degrees (90°), or again at the completion of the first stage of deployment so as to commence the second stage of deployment as assisted by the deployment spring or other such biasing means. When the fin reaches the deployment position, the retaining protrusion will slide over a recession in the base, allowing the biasing spring to deploy the fin to the final deployed position. In this way, the leading edge of the fin is always facing substantially directly into the airstream, and the chord of the fin is always in a plane parallel to the airstream, or the lengthwise axis of the projectile, thus providing the lowest amount of aerodynamic load throughout the deployment of the fin. It is important that aerodynamic aid is not required during the deployment, which provides the ability to deploy against the airstream if packaging needs require it, as can be the case for canard-based guidance systems that need to be located near the nose of the projectile. Such a control surface deployment apparatus according to aspects of the invention thus in some embodiments frees up the internal volume often used to store fins prior to their deployment and eliminates the slots through the projectile body common to fin deployment designs.

Other objects, features, and advantages of aspects of the present invention will become more apparent from the following detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Figure 1:
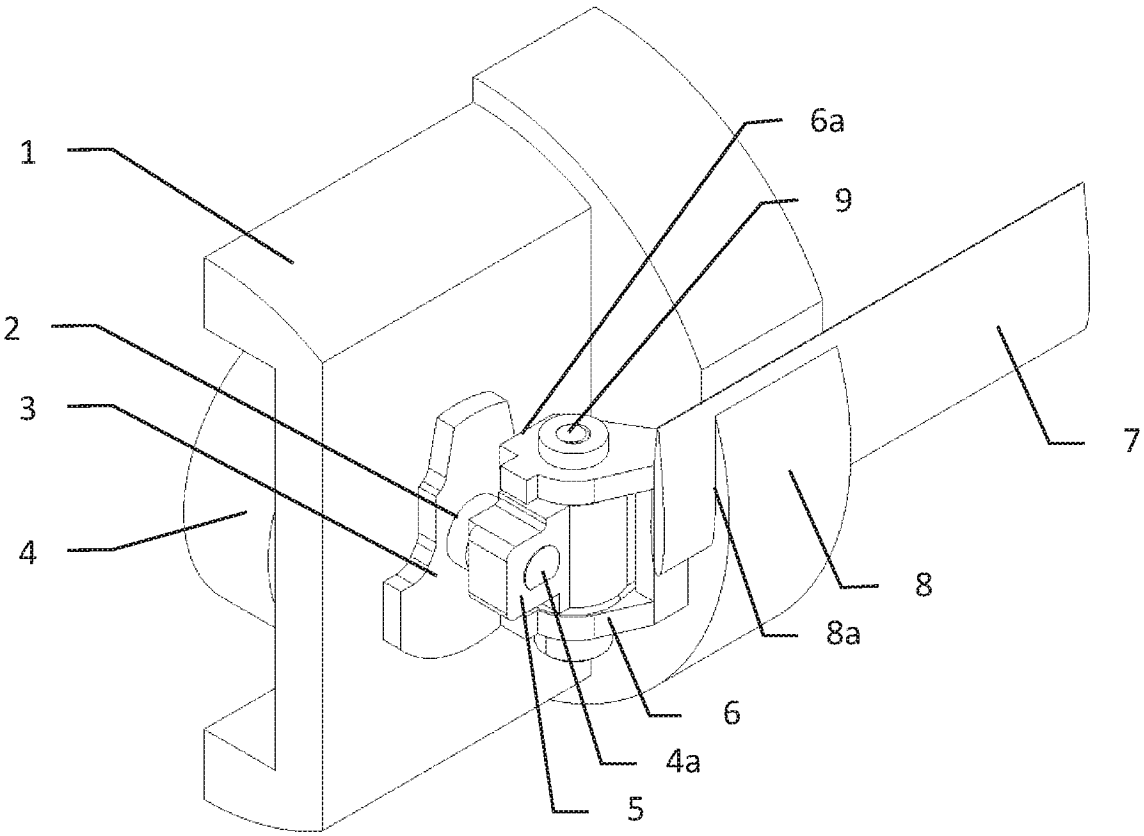
FIG. 1 is a perspective view of an exemplary control surface deployment apparatus in a first operational mode, in accordance with at least one embodiment.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments. More generally, those skilled in the art will appreciate that the drawings are schematic in nature and are not to be taken literally or to scale in terms of material configurations, sizes, thicknesses, and other attributes of an apparatus according to aspects of the present invention and its components or features unless specifically set forth herein.

DETAILED DESCRIPTION

The following discussion provides many exemplary embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

While the inventive subject matter is susceptible of various modifications and alternative embodiments, certain illustrated embodiments thereof are shown in the drawings and will be described below in detail. It should be understood, however, that there is no intention to limit the invention to any specific form disclosed, but on the contrary, the inventive subject matter is to cover all modifications, alternative embodiments, and equivalents falling within the scope of any appended claims.

By way of introduction, once more, aspects of the present invention are directed to an improved control surface deployment apparatus and method of use wherein one or more flight control surfaces or fins may be deployed by use of the same actuator that will ultimately drive the flight control surface(s) to provide projectile guidance. Alternatively, a deployment mechanism according to aspects of the present invention may also be used in situations where the fins are to be deployed but not moved during flight and thus serve as static stabilizers only. Such "flight control surfaces" or "fins," which are to be interpreted in their broadest sense, are stowed in a volume efficient manner and deployed in a way that minimizes aerodynamic drag and does not require aerodynamic assistance for deployment. As a threshold matter, the terms "projectile," "launch," and "flight" used herein are to be interpreted in their broadest sense and include any body, air or water borne, being either launched or dropped or otherwise flown or moved through a fluid medium. In fact, while the exemplary context is air flight and reference is made throughout to an "airstream," the invention is not so limited and may also relate to submersible projectiles or vessels moving through water as the fluid medium rather than air. By way of further illustration and not limitation, such a system may in some cases be deployed with the primary axis of the projectile oriented effectively into the air or fluid stream, as by being "launched," "fired," or "shot," or may be deployed with the primary axis of the projectile not directly oriented in or into the air or fluid stream, such as, for example, a projectile dropped from an airborne platform, by a hovering drone, or out the back of an airplane, though which could be the case even when the projectile is "launched," "fired," or "shot," at least to a degree.

Generally, aspects of the present invention in at least one embodiment can be described as a control surface such as a fin that has a pair of hinges at its base that operate sequentially. The first hinge to operate allows the fin's prime mover to move the tangentially stored fin around an axis perpendicular to the projectile's axis of motion, keeping the fin oriented optimally within the airstream. Tabs or stops at the base of the second hinge prevent the respective fin from rotating during this first operative movement. Once the fin has rotated approximately ninety degrees (90°) in the illustrated embodiment, the fin clears one or more tabs or stops at the base of the fin, allowing the fin to rotate about its second hinge, which is now parallel to the direction of travel. This second hinge allows the fin to rotate optimally through the airstream until it reaches its full deployment position.

Turning now to FIG. 1, there is shown a perspective view of an exemplary embodiment of a control surface deployment apparatus according to aspects of the present invention. As a further threshold matter, it should be appreciated that there is shown the apparatus standing alone as not yet being integrated within a projectile. Those skilled in the art will further appreciate that the apparatus may thus be configured in a variety of ways and as having a variety of surface and mounting features and related geometries so as to be properly installed on or in any projectile or portion thereof, such that the particular apparatus as shown and described herein is to be understood as merely illustrative and non-limiting. Once more, the drawings are schematic in nature and are not to be taken literally or to scale in terms of material configurations, sizes, thicknesses, and other attributes of an apparatus according to aspects of the present invention and its components or features. Clearly, the apparatus can not only take a variety of configurations according to aspects of the present invention in terms of adding or removing fins or other control surfaces, changing their orientations, etc., but may also be scaled up or down to suit a particular context or application.

Figure 2:
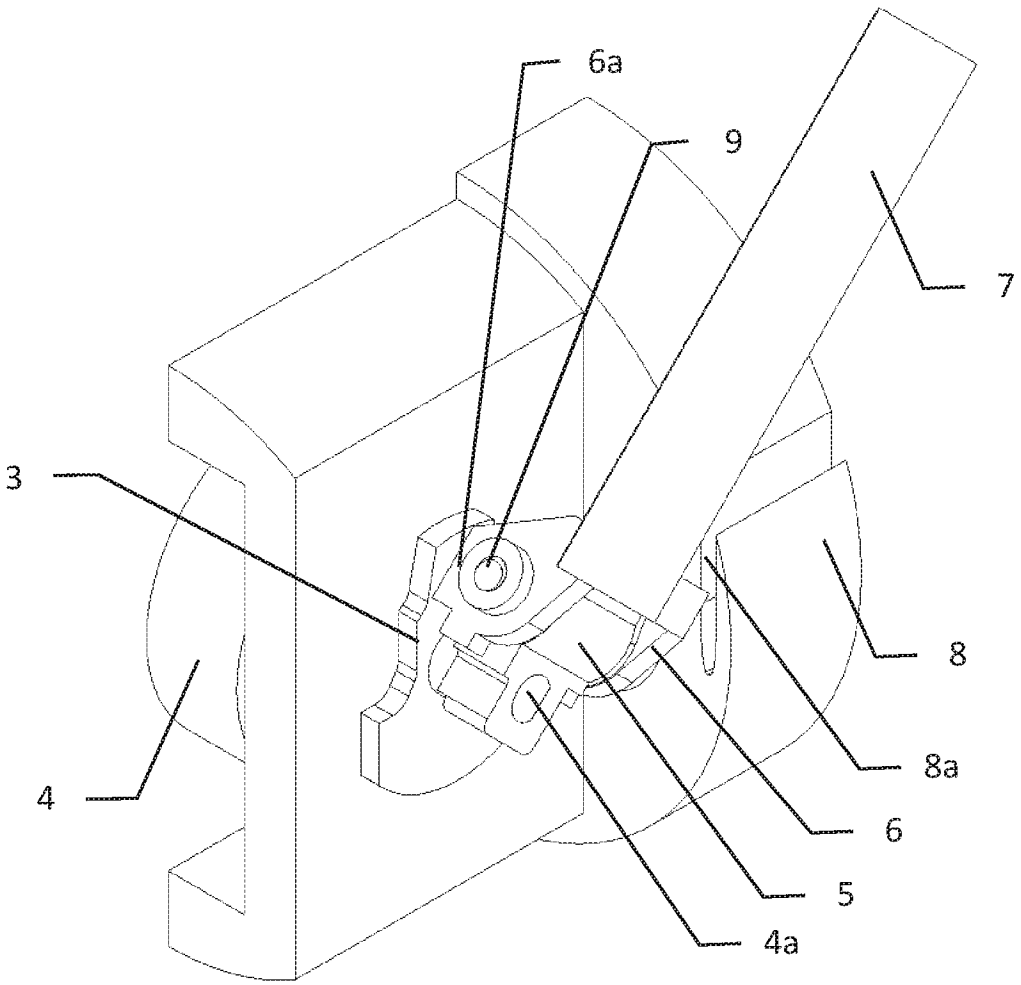
FIG. 2 is a perspective view thereof in a second operational mode, in accordance with at least one embodiment.
Figure 3:
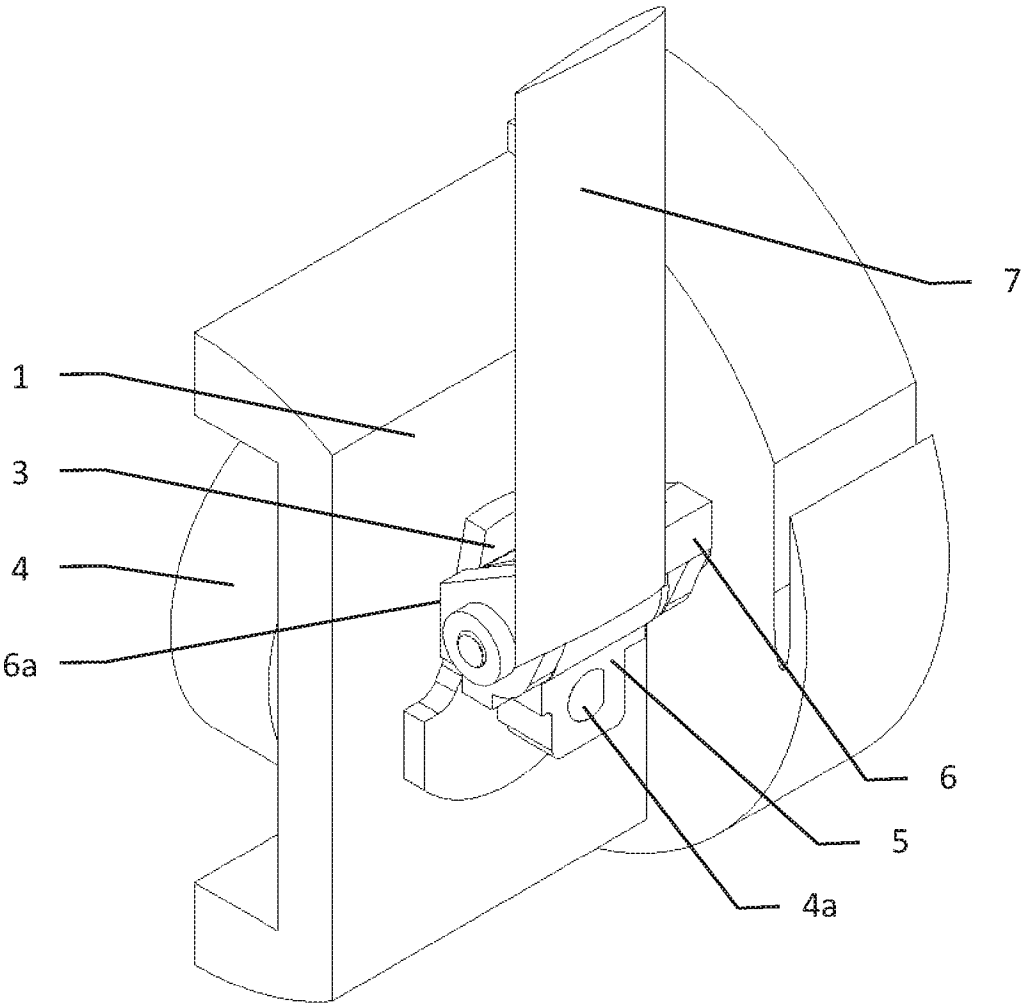
FIG. 3 is a perspective view thereof in a third operational mode, in accordance with at least one embodiment.
Figure 4:
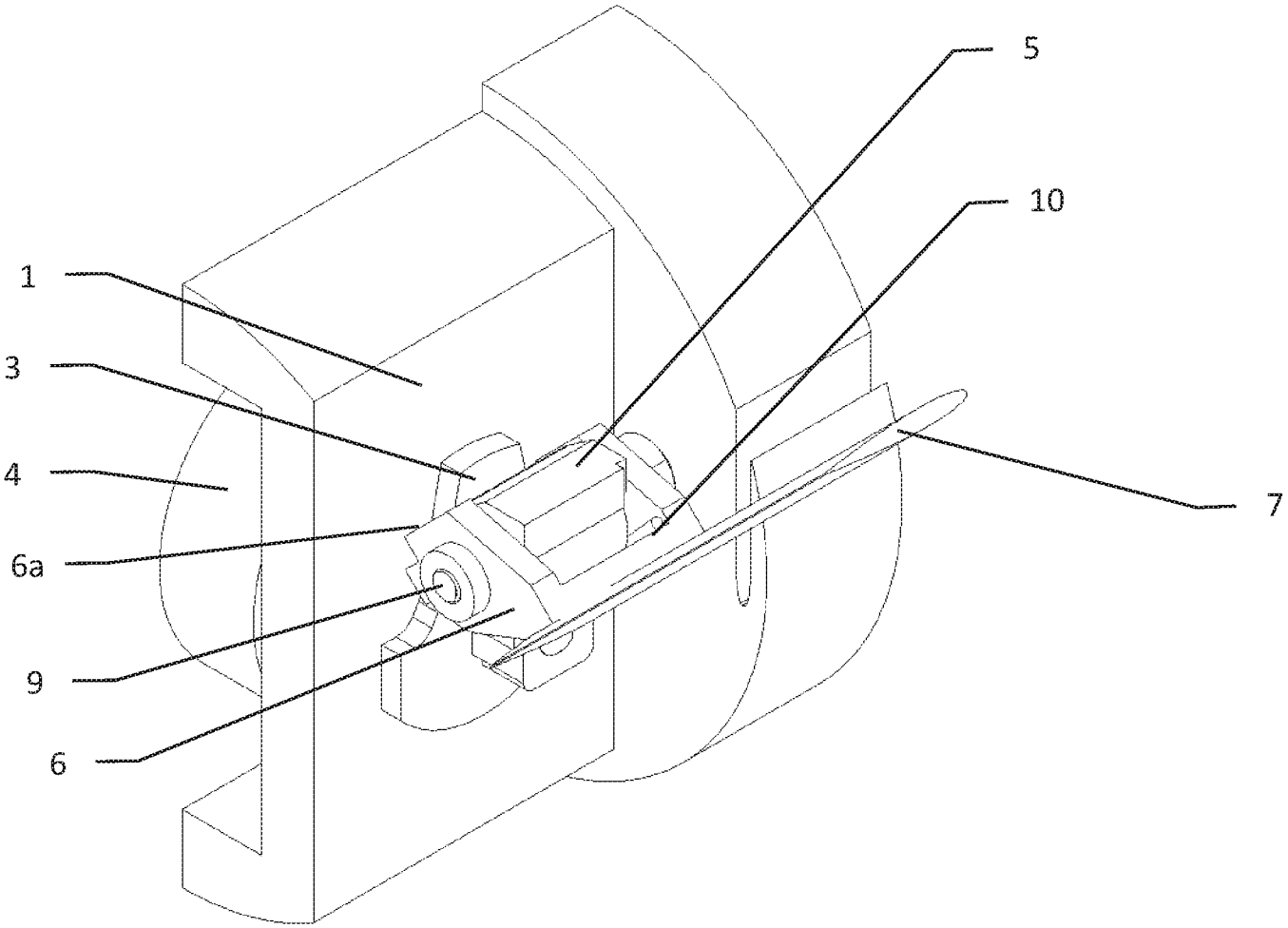
FIG. 4 is a perspective view thereof in a fourth operational mode, in accordance with at least one embodiment.
Figure 5:
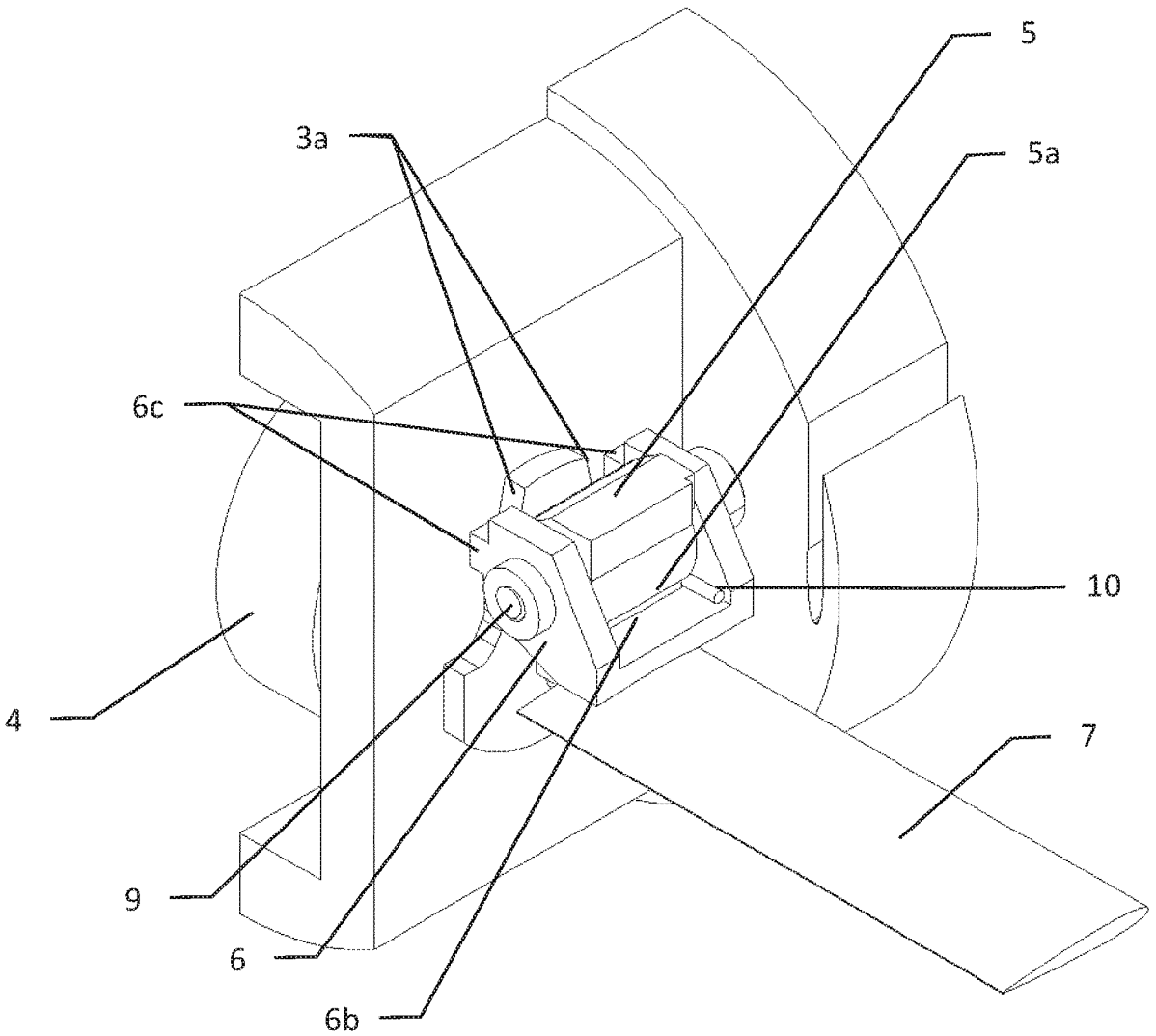
FIG. 5 is a perspective view thereof in a fifth operational mode, in accordance with at least one embodiment.

With continued reference to FIG. 1, the apparatus generally comprises, in the exemplary embodiment: a base part 1 having a center hole (not shown) with a bushing or bearing 2 and a guiding surface 3 thereabout; a drive actuator 4 operably installed on or adjacent to the base part 1 and having a drive actuator shaft 4*a* rotatably positioned within the bearing 2 so as to extend beyond the base part 1 and the guiding surface 3 thereof; a knuckle part 5 installed on the free end of the drive actuator shaft 4*a*; a hinge part 6 pivotally installed on the knuckle part 5 and having guiding surfaces 6*a* in close proximity to or in contact with the base part guiding surface 3; a fin 7 rigidly installed on the hinge part 6 so as to extend away from the knuckle part 5; a fin storage base 8 having a fin storage slot 8*a* for selective receipt of the fin 7; and a hinge pin 9 pivotally coupling the hinge part 6 onto the knuckle part 5. A spring biasing element 10 (FIGS. 4 and 5), obscured in this view, rotationally or torsionally biases the hinge part 6 relative to the knuckle part 5. In the exemplary embodiment, the base part 1 thus functions as a support frame or structure for a number of the other components, directly or indirectly. Once again, it may take a number of other forms beyond that shown, which is to be understood as illustrative and potentially truncated. Similarly, the fin storage base 8 is also shown as being truncated for clarity; in practice, the fin storage base 8 may extend further in the direction of the fin 7 in its stowed condition in order to fully support and enclose the fin 7. In this view, which is representative of the fin 7 in its stowed position or first operational mode, the fin 7 is shown as pointing towards the direction of travel of the projectile in which the apparatus is installed. During operation, the motor or drive actuator 4 will deploy the fin 7 by rotating it first around the primary rotational axis defined by the drive actuator shaft 4*a* and the bushing 2, raising the fin 7 out of the storage slot 8*a*. The hinge part sliding or guiding surfaces 6*a* will slide across the base part guiding surface 3 until substantial completion of the first deployment stage during which engagement of the guiding surfaces 3, 6*a* prevents initiation of the second deployment stage involving pivot of the hinge part 6 relative to the knuckle part 5 under the influence of the spring biasing element 10 (FIGS. 4 and 5). Effectively, during the first deployment stage as best shown in FIG. 2 the biasing spring element 10 (FIGS. 4 and 5) will press against the fin 7, and specifically in the exemplary embodiment the hinge part 6 on which the fin 7 is installed, such that the hinge part 6 and fin 7 will seek to pivot around the hinge pin 9, but the engaged sliding or guiding surfaces 3, 6*a* will not allow the hinge part 6 and thus the fin 7 to pivot around the hinge pin 9 until the opposed hinge part guiding surfaces 6*a* are clear of the base part guiding surface 3, thereby at all times keeping the fin 7 oriented directly into the airstream. Once the fin 7 reaches approximately ninety degrees (90°) of deployment or is upright in the exemplary embodiment as shown in FIG. 3, the guide surfaces 6*a* on the hinge part 6 will slip off of the guiding surface 3 of the base part 1, and the apparatus will enter the second deployment stage wherein the spring biasing element 10 will deploy the fin 7, more about which is said below. Once again, those skilled in the art will appreciate that while particular geometries and configurations of such components, including but not limited to the base part and hinge part guiding surfaces 3, 6*a* specifically and the knuckle and hinge parts 5, 6 more generally, the invention is not so limited, such that other exemplary embodiments according to aspects of the present invention are possible without departing from its spirit and scope. By way of further illustration and not limitation, while the hinge part 6 is shown as being formed with opposite, spaced apart guiding surfaces 6*a* that somewhat straddle the particular geometry of the base part guiding surface 3, other such arrangements are possible, and specifically, one or three or more hinge part guiding surface(s) 6*a* are possible in certain applications.

FIG. 2 shows the fin 7 progressing through the deployment cycle, or at an intermediate location within the first deployment stage identified as a second operational mode of the control surface deployment apparatus. The fin 7 is shown as being deployed at approximately forty-five degrees (45°) from the stowed position, simply for illustration. Once more, based on the sliding surface contact between the guiding surface(s) 6*a* on the hinge part 6 and the guiding surface 3 on the base part 1, the hinge part 6 and thus the fin 7 is unable to pivot around the hinge pin 9 even under the biasing effect of the spring element 10 (FIGS. 4 and 5). As also shown in FIG. 2, the fin storage slot 8*a* formed somewhat vertically within the fin storage base 8 can be seen as having a depth and profile substantially conforming to the fin 7 for secure storage thereof when the fin 7 is in its fully stowed first operational mode as shown in FIG. 1. Notably, at such intermediate rotational position of the fin 7, it will be appreciated that by preventing any outward pivoting of the fin 7 or of the hinge part 6 relative to the knuckle part 5, the fin 7 again remains oriented substantially directly into the airstream with any chord of the fin 7 still in a plane substantially parallel to the airstream, thereby minimizing the profile of the fin 7 relative to the airstream and thus aerodynamic drag.

Turning to FIG. 3, there is shown the exemplary control surface deployment apparatus according to aspects of the present invention in a third operational mode defined by completion of the first deployment stage and initiation of the second deployment stage, with the fin 7 all the way through the deployment actuation cycle of the main actuator 4, but before the fin 7 has moved to its final deployed position by means of the biasing spring element 10 (FIGS. 4 and 5). Here, the fin 7 has again in the exemplary embodiment rotated approximately ninety degrees (90°) into the deployment position, wherein the lengthwise axis of the fin 7 has shifted from being substantially along or parallel to the lengthwise axis or the primary travel direction of the projectile to now being substantially perpendicular to such projectile or travel direction axis. Once more, all the way through such first deployment stage, or through the approximately ninety degrees (90°) of rotation of the fin 7 and thus the hinge part 6, the fin 7 advantageously remains oriented substantially directly into the airstream. And as noted previously, the full first deployment stage is accomplished via the drive actuator 4 and its rotation or actuation of its drive actuation shaft 4*a* and thus the knuckle part 5 mounted on the shaft 4*a*, the hinge part 6 pivotally mounted on the knuckle part 5, and the fin 7 mounted on the hinge part 6, without any reliance on aerodynamic assistance. As can be seen in FIG. 3, the one or more guiding surface(s) 6*a* on the hinge part 6 are no longer in contact with the guiding surface 3 on the base part 1, allowing the hinge part 6 to pivot on the knuckle part 5 under the influence of the spring biasing element 10 and thereby fully deploy the fin 7 as shown and described in connection with the second deployment stage illustrated in FIGS. 4 and 5. It will be appreciated by those skilled in the art that a variety of mechanical arrangements for stowing and rotating the fin 7 from a first orientation along the projectile to a second orientation transverse to the projectile are possible according to aspects of the present invention, such that the arrangement of particularly the assembly of the knuckle part 5 and hinge part 6 relative to the base part 1 and the related arrangement of the base part and hinge part guiding surfaces 3, 6*a* are to be understood as merely illustrative and non-limiting. By way of further illustration and not limitation, the one or more fins may be stored and deployed independently of the air or other fluid stream direction (i.e., with the fins stored pointing forward or backward on the projectile). Furthermore, it is possible that such system be configured wherein the one or more fins are not stored pointing entirely forward or backward (or entirely along or parallel to the main axis of the projectile), in which case such fin would be stored at an angle, and so the first deployment rotation would be less than or more than ninety degrees (90°)—for example, the position of the fin 7 illustrated in FIG. 2 could represent the fin's "stored" position. In other words, while in the exemplary embodiment the system arrangement allows the one or more fins to be stored tangentially to the outer diameter of the projectile and along or parallel to the axis thereof, such is not necessarily the case. And as explained further below in connection with FIG. 6, the apparatus may be configured having a deployment scheme wherein the fins are stored externally to the main projectile body, not inside such body or any corresponding aerodynamic support or storage slot.

Referring next to FIG. 4, there is shown the fin 7 progressing further through the deployment cycle, or here at an intermediate location within the second deployment stage identified as a fourth operational mode of the control surface deployment apparatus. With the rotational position of the fin 7 relative to the projectile fixed by the drive actuator 4 so as to maintain the fin 7 as having its leading edge oriented substantially directly into the airstream, the fin 7 and the hinge part 6 may again now begin to pivot about the knuckle part 5 on the hinge pin 9. That is, FIG. 4 shows the fin 7 after being rotated ninety degrees (90°) into the deployment position and on its way to its final deployed position, wherein the hinge part 6 and attached fin 7 have begun rotating around the hinge pin 9 due to the force from the biasing spring element 10. As can be seen for the first time in this view, the spring biasing element 10 rotationally or torsionally biases the hinge part 6 relative to the knuckle part 5, causing the hinge part 6 and thus the fin 7 to pivot downwardly or outwardly and away from the base part 1 and the projectile generally. Here, the biasing spring element 10 applies a torsion load to the hinge part 6 and is anchored to the knuckle piece 5, though again a variety of such biasing members now known or later developed and related installation configurations are possible according to aspects of the present invention without departing from its spirit and scope. Once more, such free rotational or pivoting movement of the hinge part 6 and fin 7 about the hinge pin 9 is accomplished or possible once the apparatus completes the first stage of deployment with the fin 7 having shifted approximately ninety degrees (90°) from its stowed condition as shown in FIG. 1 to the position shown at the end of the first deployment stage and beginning of the second deployment stage as shown in FIG. 3, and specifically because the guiding surfaces 6*a*, 3 on the hinge part 6 and base part 1, respectively, are now no longer in contact as herein shown and described.

Finally, with reference to FIG. 5, the exemplary control surface deployment apparatus is shown in its final deployed state, designated here as the fifth operational mode, wherein the main actuator 4 remains in its default deployment rotational position with the fin 7 still oriented as having its leading edge substantially directly into the airstream and its lengthwise axis substantially perpendicular to the central lengthwise axis of the projectile, now with the fin 7 substantially aligned axially with the drive actuator 4 and the shaft 4*a* (FIG. 3) thereof for operation of the one or more fins 7 by the drive actuator 4 in selectively rotating the fin 7 to "steer" the projectile or provide projectile guidance. It will again be appreciated by those skilled in the art that beneficially the same drive actuator 4 that deployed the fin(s) 7 during the first stage is employed in adjusting or steering the fin(s) 7 upon completion of the second stage or full deployment. It is noted that in this position, the biasing spring element 10 has pushed the fin 7 to an approximately horizontal position, where a hard-stop edge 6*b* of the hinge part 6 is now contacting an adjacent hard-stop edge 5*a* of the knuckle part 5 in order to define the furthest location that the spring 10 can bias or push the hinge part 6 and fin 7. It will be appreciated that while in the exemplary embodiment the hinge part 6 and thus the fin 7 rotates about the hinge pin 9 and thus the knuckle part 5 also through roughly ninety degrees (90°), the invention is again not so limited, and in other configurations of the system and for a variety of reasons the one or more fins 7 in its/their stored state may not be parallel to each other, and regardless the angle through which the hinge part 6 and fin 7 rotates from the end of the first deployment stage to the end of the second deployment stage, as when in the exemplary embodiment the hard-stop edge 6*b* of the hinge part 6 is in contact with the hard-stop edge 5*a* of the knuckle part 5, may be greater than, less than, or equal to ninety degrees (90°). A one-way bearing or other anti-back-drive mechanism (like a sprung latch) (not shown) prevents the fin 7 from pivoting backward around the hinge pin 9 towards its stowed position, thereby effectively locking the fin 7 in its fully deployed position, though that is not necessarily the case, as in some applications it may be desirable to reverse the deployment and re-stow the one or more fins. The motor or actuator 4 may now drive the fin 7 around the main rotation axis of the fin 7 in order to steer the projectile. In this full deployment mode, certain applications may require or benefit from mechanical stops that prevent overtravel of the fin 7 around the main rotation axis of the fin 7. Tabs 6*c* included on the hinge part 6 will, as part of the transition into the fully deployed fifth operational state, move such that they are near to hard stop points 3*a* formed on or into the base part guiding surface 3. If the fin 7 rotates around its primary axis to a predefined limit, one of the tabs 6*c* will contact its corresponding stop point 3*a*, preventing further motion or rotation in that direction. By way of further illustration and not limitation, any such overtravel stops integrated into an exemplary system may be such that the fin, after deployment, has a reduced range of motion of, for example, of plus or minus ten degrees (+/−10°) from its deployed "neutral" position as shown in FIG. 5.

There is thus provided a control surface deployment apparatus and method of use according to aspects of the present invention wherein one or more flight control surfaces or fins may be deployed by use of the actuator that will ultimately drive the flight control surface(s) to provide projectile guidance, thus advantageously without the need for any secondary actuators for control surface deployment. Each such flight control surface is stowed in a volume efficient manner, particularly when within the projectile body, and deployed in a way that minimizes aerodynamic drag and does not require aerodynamic assistance. In connection with such operation, and employing the present nomenclature, it will be appreciated by those skilled in the art that fundamentally there is beneficially provided such a control surface deployment apparatus wherein in a first stage of deployment the fin is rotated only in a plane substantially parallel to the primary axis of projectile travel and sequentially in a second stage of deployment the fin is pivoted only about an axis that is substantially parallel to the primary axis of projectile travel, whereby at all times throughout both the first and second deployment stages the fin remains oriented with its leading edge into the airstream. Once more, in the exemplary embodiment it is presumed that in the stowed position of the fin it is pointing into the airstream and so rotates during the first deployment stage with, rather than against, the airstream. However, it will be appreciated as noted above that in other embodiments the stowed position of the fin may be such that the fin is pointing away from the airstream, or effectively "downstream," in which case the fin rotates into or against the airstream during the first deployment stage, which is enabled via the actuator deployment during the first stage, there being no reliance on airstream assistance and so being able to deploy the fin into the airstream; assuming the same exemplary apparatus as shown and described herein in connection with FIGS. 1-5 now with only the direction of projectile travel or the airstream reversed, it will be appreciated that, "all else being equal," the fin would also be reversed so that its leading edge in the stowed position would be pointing up rather than down. Of course, those skilled in the art will appreciate that a variety of such mechanical and kinematic arrangements and relationships are possible according to aspects of the present invention, such that the exemplary apparatus and component configurations is to be understood as illustrative and non-limiting. By way of further illustration and not limitation, the apparatus may instead be configured to deploy the fin from below rather than above and in any radial position about the projectile. In a bit more detail, then, in summarizing features and aspects of the present invention in construction and use, there is again disclosed a control surface deployment apparatus in which in a first stage of deployment the fin is rotated only in a plane substantially parallel to the primary axis of projectile travel, or the central lengthwise axis of the projectile, from a first position or operational mode wherein the fin is stowed with its lengthwise axis, or the axis of the fin itself about which it rotates when in its deployed state, substantially parallel to the primary axis of the projectile, to a third position or operational mode wherein the fin has rotated approximately ninety degrees (90°) into the deployment position, wherein the lengthwise axis of the fin has shifted from being substantially along or parallel to the lengthwise axis or the primary travel direction of the projectile to now being substantially perpendicular to such projectile or travel direction axis, with an intermediate orientation of the fin between the first and third operational modes, still being part of the first deployment stage, being generally designated as a second operational mode of the apparatus. Then, in the second stage of deployment, the fin is no longer rotated but is only pivoted about an axis that is substantially parallel to the primary axis of projectile travel, here from the third position or operational mode of the fin that again marks both the end of the first deployment stage and the beginning of the second deployment stage, wherein the lengthwise axis of the fin has shifted, while at all times being substantially perpendicular to the projectile or travel direction axis, from an orientation substantially perpendicular to the primary rotational axis of the fin in its deployed state, or the axis of the actuator drive shaft and thus the lengthwise axis of the fin itself when deployed, to an orientation substantially parallel to and aligned with the primary rotational axis or the axis of the actuator drive shaft, which defines the fifth and fully deployed operational mode of the apparatus, with an intermediate orientation of the fin between the third and fifth operational modes, still being part of the second deployment stage, being generally designated as a fourth operational mode of the apparatus. Once more, at all times during both the first and second stages of deployment the fin is oriented with its leading edge substantially into the airstream, or with its chord in a plane that is parallel to the axis of travel or the central lengthwise axis of the projectile, though not always the same plane of course. Continuing with the exemplary embodiment, when stowed, the fin is contained by and prevented from deploying by the body of the projectile or storage area and by a shaped protrusion at the base of the fin deployment mechanism. When the fin is to be deployed, the fin drive actuator is engaged to rotate the entire fin out of the holding slot on the side of the projectile. Since the fin is stowed parallel to the axis of travel and at all times during its first stage of deployment has its chord in a plane that is also parallel to the axis of travel, or the central lengthwise axis of the projectile, the fin will see the minimum amount of aerodynamic load as it enters the airstream. After the fin has traveled approximately ninety degrees (90°) so as to complete the first stage of deployment, the fin will be oriented with the leading edge substantially perpendicular to the direction of travel. In commencing the second stage of deployment of the fin, a deployment spring will then cause rotation about a secondary axis at the base of the fin which is perpendicular to the primary rotation axis of the fin and is at that point substantially parallel with the primary travel direction or central lengthwise axis of the projectile. The fin will then stop when it has been deployed into its final position by use of hard stops. Re-closure of the fin is prevented with a one-way bearing, clutch, or a sprung catch. Meanwhile, the aforementioned retaining protrusion has slid across a specifically designed surface at the base of the deployment mechanism. This surface and protrusion are designed such that the fin will not deploy while pivoting from the stowed position to the ninety degree (90°)position, but will allow the fin to deploy once it has reached the designated deployment position at approximately ninety degrees (90°) , or again at the completion of the first stage of deployment so as to commence the second stage of deployment as assisted by the deployment spring or other such biasing means. When the fin reaches the deployment position, the retaining protrusion will slide over a recession in the base, allowing the biasing spring to deploy the fin to the final deployed position. In this way, the leading edge of the fin is always facing basically directly into the airstream, and the chord of the fin is always in a plane parallel to the airstream, thus providing the lowest amount of aerodynamic load throughout the deployment of the fin. It is important that aerodynamic aid is not required during the deployment, which again provides the ability to deploy against the airstream if packaging needs require it, as can be the case for canard-based guidance systems that need to be located near the nose of the projectile, for example. Such a control surface deployment apparatus according to aspects of the invention thus may free up the internal volume often used to store fins before their deployment and may thereby eliminate the slots through the projectile body common to prior art fin deployment designs.

In use, a control surface deployment apparatus according to aspects of the present invention has several benefits. First, it allows the fins to be stored in (or near to) the outer shell of the projectile, thus maximizing internal storage area that can be used for other payloads. Other fin storage methods may store the fins internal to the cavity of the projectile but orient the fins radially within the body of the projectile; this takes up considerable room inside the body of the projectile that could be used for other payloads. Secondly, aspects of the present invention allow a projectile to deploy individually controlled fins with their primary actuation motor. Many other designs use a secondary actuator to retain and/or deploy fins; this adds complexity and cost to the system. Again, the proposed invention requires no secondary actuator to retain or deploy the fins. Thus, aspects of the present invention involve relatively lower costs in terms of the components and/or manufacturing and assembly steps. Thirdly, the system orients the fins such that they can be supported along the length of the fins. This large support area can greatly reduce the stresses generated during high accelerations and vibrations. Fourthly, the fins deploy smoothly into the airstream. The proposed invention orients the leading edge of the fin directly into the airstream during the entire deployment process. This is in contrast to designs that may store the fins in a similar way, but would deploy them by temporarily exposing a larger surface area of the fins into the airstream, which can cause extreme loads to the system and can change the trajectory of the projectile. Finally, because the system does not require airstream aid for deployment, fins can be deployed against the airstream.

In an alternative exemplary embodiment of a control surface deployment apparatus according to aspects of the present invention, the fin deployment system as described herein is employed, but with a plurality of such systems attached to the projectile. For example, four independent storage and deployment mechanisms could be used to provide four independent selectively deployable and steerable fins. That is, aspects of the present invention relate to a system that may use several deployment mechanisms or components to implement several independent axes of motion, with any number of such control surfaces or fins, or pairs thereof, being exemplary and non-limiting.

In a still further alternative exemplary embodiment, a fin deployment system according to aspects of the present invention is employed, but with more than one fin attached to the same deployment motor or actuator. For example, a single deployment motor would be able to deploy and operate two fins arranged symmetrically around a projectile body, such as at opposite ends of a common or coupled drive shaft. In this example the fins would be controlled by the same motor and would not be independently operated.

In yet another alternative exemplary embodiment of a control surface deployment apparatus according to aspects of the present invention, the fins are stowed pointing toward the rear of the projectile allowing them to deploy in the same manner, but against the airstream, as set forth herein.

In still another alternative exemplary embodiment of a control surface deployment apparatus according to aspects of the present invention, the fin deployment system may be used to deploy a static fin(s) used for stabilization only. Once deployed, the static fin(s) would not be actuated further by the deploying motor.

Figure 6:
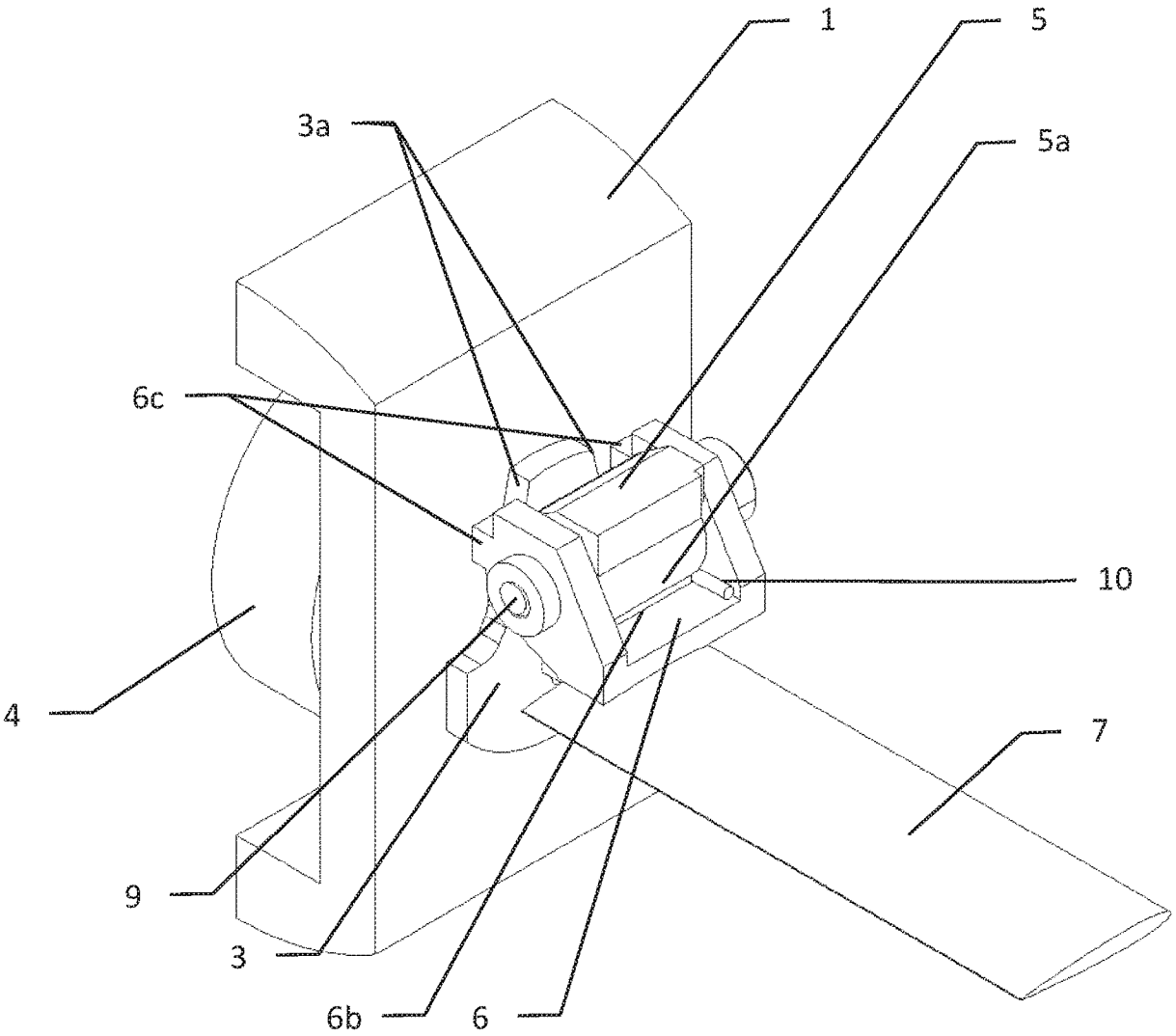
FIG. 6 is a perspective view of an alternative exemplary control surface deployment apparatus in the illustrated fifth operational mode, in accordance with at least one embodiment.

Another alternative exemplary embodiment is shown in FIG. 6. This embodiment shows virtually the same apparatus as in FIGS. 1-5, but without the fin storage base 8. In this embodiment, a fin deployment system according to aspects of the present invention is employed, but without requiring a fin storage base as shown in the first exemplary embodiment. This alternative embodiment allows the fin 7 to remain outside of, but in a plane tangent to, the primary axis of the projectile. The benefit to such an arrangement is a greatly simplified projectile housing in which no fin storage areas are required. This benefit comes at the cost of a higher or greater external profile. This embodiment is specifically shown to exemplify, but not limit, an alternative usage of the control surface deployment apparatus in systems that do not use the proposed storage base 8 or other such dedicated structure, the deployment system, and particularly its base part 1, still otherwise being installed on or in or otherwise incorporated into the projectile as appropriate for the application. Other systems may include, for example, removable panels or fabric coverings of the fins in their undeployed state (the first operational mode).

And in a still further alternative exemplary embodiment of a control surface deployment apparatus according to aspects of the present invention, such apparatus is configured for or allows operation underwater in order to steer a torpedo or similar projectile device. Instead of using the fins to steer a projectile through the air, they would be used to steer a device either totally or partially submerged in water. The benefits of this system are almost identical to the benefits of the first embodiment but with the exception that they operate using water as the traversed medium instead of air.

Aspects of the present specification may also be described as follows:

1. A control surface deployment apparatus comprising: a base part; a drive actuator operably installed adjacent to the base part and having a drive actuator shaft extending beyond the base part; a knuckle part installed on the drive actuator shaft so as to selectively rotate therewith; a hinge part pivotally installed on the knuckle part as through a hinge pin; a fin rigidly installed on the hinge part so as to extend away from the knuckle part; and a spring biasing element configured to pivotally bias the hinge part relative to the knuckle part; wherein the drive actuator causes a first stage of deployment of the fin by selectively rotating the drive actuator shaft to rotate the knuckle part and the hinge part, thereby rotating the fin from a stowed position to an intermediate position; and wherein the spring biasing element causes a second stage of deployment of the fin by selectively pivoting the hinge part about the hinge pin relative to the knuckle part, thereby pivoting the fin from the intermediate position to a fully deployed position.

2. The apparatus of embodiment 1 wherein at all times during the first and second stages of deployment a chord of the fin is in a plane parallel to a lengthwise axis of a projectile in which the apparatus is operably installed.

3. The apparatus of embodiment 1 or embodiment 2 wherein the drive actuator shaft is perpendicular to the lengthwise axis of the projectile.

4. The apparatus of any of embodiments 1-3 further comprising a bearing about the drive actuator shaft, the drive actuator shaft extending beyond the bearing.

5. The apparatus of any of embodiments 1-4 further comprising: a base part guiding surface formed on the base part about the drive actuator shaft; and an at least one hinge part guiding surface formed on the hinge part so as to be in close proximity to the base part guiding surface; wherein the proximity of the at least one hinge part guiding surface to the base part guiding surface prevents pivotal movement of the hinge part relative to the knuckle part during the first stage of deployment as the drive actuator shaft rotates until the fin reaches the intermediate position and the at least one hinge part guiding surface is clear of the base part guiding surface so as to allow commencement of the second stage of deployment under the biasing effect of the spring biasing element.

6. The apparatus of any of embodiments 1-5 wherein the rotation of the drive actuator shaft during the first stage of deployment is approximately ninety degrees.

7. The apparatus of embodiment 5 or embodiment 6 wherein the hinge part guiding surface is parallel to the fin.

8. The apparatus of any of embodiments 5-7 wherein the drive actuator shaft extends beyond the base part guiding surface.

9. The apparatus of any of embodiments 1-8 further comprising: a knuckle part hard-stop edge formed on the knuckle part; and a hinge part hard-stop edge formed on the hinge part, the hinge part hard stop edge contacting the knuckle part hard-stop edge so as to prevent further pivoting of the hinge part relative to the knuckle part when the fin is in the fully deployed position.

10. The apparatus of any of embodiments 1-9 wherein the pivoting of the hinge part relative to the knuckle part during the second stage of deployment is approximately ninety degrees.

11. The apparatus of embodiment 9 or embodiment 10 wherein the hinge part hard-stop edge is perpendicular to the fin.

12. The apparatus of any of embodiments 5-11 further comprising: spaced-apart tabs formed on the hinge part so as to extend away from the fin; and opposite hard stops formed on the base part guiding surface to be selectively contacted by the respective tabs upon rotation of the drive actuator shaft and of the fin in its fully deployed position to set limits on such rotation of the fin.

13. The apparatus of embodiment 12 wherein the rotational limits of the fin as dictated by selective engagement of the tabs with the hard stops are plus or minus ten degrees.

14. The apparatus of any of embodiments 1-13 further comprising a fin storage base having a fin storage slot for receipt and support of the fin in the stowed position.

15. The apparatus of any of embodiments 1-14 wherein in the stowed position the fin is parallel to a lengthwise axis of a projectile in which the apparatus is operably installed.

16. The apparatus of any of embodiments 1-15 wherein in the stowed position the fin points into the airstream in which the apparatus is moving.

17. The apparatus of any of embodiments 1-15 wherein in the stowed position the fin points away from the airstream in which the apparatus is moving.

18. The apparatus of any of embodiments 1-17 wherein in the intermediate position the fin is perpendicular to the airstream in which the apparatus is moving.

19. The apparatus of any of embodiments 1-18 wherein in the intermediate position the hinge pin is parallel to a lengthwise axis of a projectile in which the apparatus is operably installed.

20. The apparatus of any of embodiments 1-19 wherein no secondary actuator is required to fully deploy the fin.

21. The apparatus of any of embodiments 1-20 wherein the drive actuator singularly deploys and controls the fin.

22. The apparatus of any of embodiments 1-21 wherein the airstream in which the apparatus is moving is not required to fully deploy the fin.

23. The apparatus of any of embodiments 1-22 wherein the drive actuator deploys and controls a plurality of fins.

24. A method of employing a control surface deployment apparatus as defined in any one of embodiments 1-23, the method comprising the steps of: stowing the fin in the stowed position; rotating the drive actuator shaft to thereby rotate the fin to the intermediate position; and pivoting the fin under the influence of the spring biasing element to the fully deployed position.

25. The method of embodiment 24, wherein the step of stowing the fin includes securing the fin within the fin storage slot formed in the fin storage base.

26. The method of embodiment 24 or embodiment 25, wherein the step of stowing the fin takes place internally of a housing of a projectile in which the apparatus is operably installed.

27. The method of any of embodiments 24-26, wherein the step of stowing the fin takes place externally of a housing of a projectile in which the apparatus is operably installed.

28. The method of any of embodiments 24-27, wherein the steps of rotating the drive actuator shaft and pivoting the fin are sequential.

29. The method of any of embodiments 24-28, comprising the further step of preventing pivoting the fin until the fin is rotated by the drive actuator shaft to the intermediate position.

30. The method of any of embodiments 24-29, wherein the step of rotating the drive actuator shaft in turn rotates a plurality of fins.

31. The method of any of embodiments 24-30, wherein the step of rotating the drive actuator shaft in turn rotates two opposed fins.

32. The method of any of embodiments 24-31, wherein the step of pivoting the fin does not require airstream assistance.

33. The method of any of embodiments 24-32, wherein the step of pivoting the fin is about an axis parallel to the lengthwise axis of a projectile in which the apparatus is operably installed.

34. The method of any of embodiments 24-33, wherein a plurality of apparatuses are employed in implementing a plurality of independent axes of motion of a fin.

35. The method of any of embodiments 24-34, comprising the further step of installing the apparatus in a projectile.

36. The method of embodiment 35, wherein the projectile is employed in a fluid selected from the group consisting of air and water.

37. The method of embodiment 35 or embodiment 36, wherein the projectile is not directly oriented in an airstream.

38. A kit comprising a control surface deployment apparatus as defined in any one of embodiments 1-23.

39. The kit of embodiment 38, further comprising instructional material.

40. The kit of embodiment 39, wherein the instructional material provides instructions on how to perform the method as defined in any one of embodiments 24-37.

41. Use of a control surface deployment apparatus as defined in any one of embodiments 1-23 to both deploy and control a fin using a single drive actuator.

42. The use of embodiment 41, wherein the use comprises a method as defined in any one of embodiments 24-37.

In closing, regarding the exemplary embodiments of the present invention as shown and described herein, it will be appreciated that an improved control surface deployment apparatus and method of use is disclosed and configured for efficient storage and deployment of control surfaces. Because the principles of the invention may be practiced in a number of configurations beyond those shown and described, it is to be understood that the invention is not in any way limited by the exemplary embodiments, but is generally directed to a control surface deployment apparatus that requires only the primary motor or actuator for both fin deployment and operation and allows the fins to stow in a volume advantageous position flat against the projectile body, requires no aerodynamic aid for deployment, and minimizes aerodynamic drag during fin deployment and so is able to take numerous forms in doing so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

In some embodiments, the numbers expressing quantities of ingredients, properties such as concentration, reaction conditions, and so forth, used to describe and claim certain embodiments of the inventive subject matter are to be understood as being modified in some instances by the terms "about" or "approximately." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in the specific examples are reported as precisely as practicable. The numerical values presented in some embodiments of the inventive subject matter may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. The recitation of numerical ranges of values herein is merely intended to serve as a shorthand method of referring individually to each separate value falling within the range. Unless otherwise indicated herein, each individual value of a numerical range is incorporated into the specification as if it were individually recited herein. Similarly, all lists of values should be considered as inclusive of intermediate values unless the context indicates the contrary.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the inventive subject matter and does not pose a limitation on the scope of the inventive subject matter otherwise claimed. No language in the application should be construed as indicating any non-claimed element essential to the practice of the invention.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

While aspects of the invention have been described with reference to at least one exemplary embodiment, it is to be clearly understood by those skilled in the art that the invention is not limited thereto. Rather, the scope of the invention is to be interpreted only in conjunction with any appended claims here or in any patent application claiming the benefit hereof, and it is made clear that the inventor(s) believe that the claimed subject matter is the invention.

What is claimed is:

1. A control surface deployment apparatus comprising:

a base part;

a drive actuator operably installed adjacent to the base part and having a drive actuator shaft extending beyond the base part;

a knuckle part installed on the drive actuator shaft so as to selectively rotate therewith;

a hinge part pivotally installed on the knuckle part as through a hinge pin;

a fin rigidly installed on the hinge part so as to extend away from the knuckle part; and a spring biasing element configured to pivotally bias the hinge part relative to the knuckle part;

wherein the drive actuator causes a first stage of deployment of the fin by selectively rotating the drive actuator shaft to rotate the knuckle part and the hinge part, thereby rotating the fin from a stowed position to an intermediate position; and wherein after the fin has reached the intermediate position at the conclusion of the first stage of deployment, the spring biasing element causes a second stage of deployment of the fin by selectively pivoting the hinge part about the hinge pin relative to the knuckle part, thereby pivoting the fin from the intermediate position to a fully deployed position.

2. The apparatus of claim 1 wherein at all times during the first and second stages of deployment a chord of the fin is in a plane parallel to a lengthwise axis of a projectile in which the apparatus is operably installed.

3. The apparatus of claim 1 wherein the drive actuator shaft is perpendicular to the lengthwise axis of the projectile.

4. The apparatus of claim 1 further comprising:

a base part guiding surface formed on the base part about the drive actuator shaft; and an at least one hinge part guiding surface formed on the hinge part so as to be in close proximity to the base part guiding surface;

wherein the proximity of the at least one hinge part guiding surface to the base part guiding surface prevents pivotal movement of the hinge part relative to the knuckle part during the first stage of deployment as the drive actuator shaft rotates until the fin reaches the intermediate position and the at least one hinge part guiding surface is clear of the base part guiding surface so as to allow commencement of the second stage of deployment under the biasing effect of the spring biasing element.

5. The apparatus of claim 4 wherein the rotation of the drive actuator shaft during the first stage of deployment is approximately ninety degrees.

6. The apparatus of claim 4 wherein the hinge part guiding surface is parallel to the fin.

7. The apparatus of claim 4 further comprising:

a knuckle part hard-stop edge formed on the knuckle part; and a hinge part hard-stop edge formed on the hinge part, the hinge part hard-stop edge contacting the knuckle part hard stop edge so as to prevent further pivoting of the hinge part relative to the knuckle part when the fin is in the fully deployed position.

8. The apparatus of claim 7 wherein the pivoting of the hinge part relative to the knuckle part during the second stage of deployment is approximately ninety degrees.

9. The apparatus of claim 7 wherein the hinge part hard-stop edge is perpendicular to the fin.

10. The apparatus of claim 4 further comprising:

spaced-apart tabs formed on the hinge part so as to extend away from the fin; and opposite hard stops formed on the base part guiding surface to be selectively contacted by the respective tabs upon rotation of the drive actuator shaft and of the fin in its fully deployed position to set limits on such rotation of the fin.

11. The apparatus of claim 10 wherein the rotational limits of the fin as dictated by selective engagement of the tabs with the hard stops are plus or minus ten degrees.

12. The apparatus of claim 1 further comprising a fin storage base having a fin storage slot for receipt and support of the fin in the stowed position.

13. The apparatus of claim 1 wherein in the stowed position the fin is parallel to a lengthwise axis of a projectile in which the apparatus is operably installed.

14. The apparatus of claim 1 wherein in the stowed position the fin points away from the airstream in which the apparatus is moving.

15. The apparatus of claim 1 wherein in the intermediate position the fin is perpendicular to the airstream in which the apparatus is moving.

16. The apparatus of claim 15 wherein in the intermediate position the hinge pin is parallel to a lengthwise axis of a projectile in which the apparatus is operably installed.

17. The apparatus of claim 1 wherein the drive actuator singularly deploys and controls the fin.

18. The apparatus of claim 1 wherein the airstream in which the apparatus is moving is not required to fully deploy the fin.

19. A control surface deployment apparatus comprising:

a base part having a base part guiding surface;

a knuckle part installed on a drive actuator shaft so as to selectively rotate therewith;

a hinge part pivotally installed on the knuckle part as through a hinge pin, an at least one hinge part guiding surface formed on the hinge part so as to be in close proximity to the base part guiding surface; and a fin rigidly installed on the hinge part so as to extend away from the knuckle part;

wherein rotation of the drive actuator shaft causes a first stage of deployment of the fin by selectively rotating the knuckle part and the hinge part, thereby rotating the fin from a stowed position to an intermediate position;

wherein the proximity of the at least one hinge part guiding surface to the base part guiding surface prevents pivotal movement of the hinge part relative to the knuckle part during the first stage of deployment as the drive actuator shaft rotates until the fin reaches the intermediate position and the at least one hinge part guiding surface is clear of the base part guiding surface so as to allow commencement of a second stage of deployment of the fin by selectively pivoting the hinge part about the hinge pin relative to the knuckle part as caused by a spring biasing element acting on the hinge part, thereby pivoting the fin from the intermediate position to a fully deployed position; and wherein at all times during the first and second stages of deployment a chord of the fin is in a plane parallel to a lengthwise axis of a projectile in which the apparatus is operably installed.

20. A control surface deployment apparatus comprising:

a drive actuator having a drive actuator shaft perpendicular to a lengthwise axis of a projectile in which the apparatus is operably installed;

a knuckle part installed on the drive actuator shaft so as to selectively rotate therewith;

a hinge part pivotally installed on the knuckle part;

a fin rigidly installed on the hinge part so as to extend away from the knuckle part; and a spring biasing element configured to pivotally bias the hinge part relative to the knuckle part;

wherein the drive actuator causes a first stage of deployment of the fin by selectively rotating the drive actuator shaft to rotate the knuckle part and the hinge part, thereby rotating the fin from a stowed position to an intermediate position;

wherein after the fin has reached the intermediate position at the conclusion of the first stage of deployment, the spring biasing element causes a second stage of deployment of the fin by selectively pivoting the hinge part relative to the knuckle part, thereby pivoting the fin from the intermediate position to a fully deployed position; and wherein at all times during the first and second stages of deployment a chord of the fin is in a plane parallel to the lengthwise axis of the projectile.

21. A control surface deployment apparatus comprising:

a base part having a base part guiding surface;

a knuckle part installed on the drive actuator shaft so as to selectively rotate therewith;

a hinge part pivotally installed on the knuckle part;

a fin rigidly installed on the hinge part so as to extend away from the knuckle part;

spaced-apart tabs formed on the hinge part so as to extend away from the fin; and opposite hard stops formed on the base part guiding surface to be selectively contacted by the respective tabs upon rotation of the drive actuator shaft and of the fin;

wherein rotation of the drive actuator shaft causes a first stage of deployment of the fin by selectively rotating the knuckle part and the hinge part, thereby rotating the fin from a stowed position to an intermediate position;

wherein after the fin has reached the intermediate position at the conclusion of the first stage of deployment, clearance between the hinge part and the knuckle part causes a second stage of deployment of the fin by selectively pivoting the hinge part relative to the knuckle part, thereby pivoting the fin from the intermediate position to a fully deployed position; and wherein selective contact between the opposite hard stops and the respective tabs sets limits on rotation of the fin in the fully deployed position.

* * * * *